United States Patent [19]

Blas et al.

[11] 4,184,899

[45] Jan. 22, 1980

[54] METHOD OF SURFACE HARDENING STAINLESS STEEL PARTS

[75] Inventors: Amos Blas, Ramat Gan; Baruch Rabin, Rechovot, both of Israel

[73] Assignee: Israel Aircraft Industries Ltd., Ben Gurion Int'l Airport, Ltd., Israel

[21] Appl. No.: 926,434

[22] Filed: Jul. 20, 1978

[30] Foreign Application Priority Data

Jul. 25, 1977 [IL] Israel ..... 52591

[51] Int. Cl.[2] ..... C21D 1/48

[52] U.S. Cl. ..... 148/15.5; 148/16.6

[58] Field of Search ..... 148/15.5, 16.6, 15, 148/27

[56] References Cited

U.S. PATENT DOCUMENTS

| | | | |
|---|---|---|---|
| 3,753,799 | 8/1973 | Wells | 148/15.5 |
| 4,006,043 | 2/1977 | Gaucher et al. | 148/15.5 |
| 4,019,928 | 4/1977 | Beyer et al. | 148/15.5 |

*Primary Examiner*—L. Dewayne Rutledge
*Assistant Examiner*—John P. Sheehan
*Attorney, Agent, or Firm*—Benjamin J. Barish

[57] ABSTRACT

A method of surface hardening stainless steel parts for increasing their wear and fatigue resistance comprises (a) subjecting the surface of the stainless steel part to a salt bath containing, by weight, up to 0.5% sulphur, 4–30% of a cyanide, and 10–30% of a cyanate, for a time period of a few minutes to two hours, at a temperature of 540°–600° C.; and (b) then subjecting the stainless steel part to a nitriding process.

9 Claims, No Drawings

METHOD OF SURFACE HARDENING STAINLESS STEEL PARTS

BACKGROUND OF THE INVENTION

The present invention relates to a method of surface hardening stainless steel parts for increasing their wear and fatigue resistance.

Nitriding surface hardening processes are commonly used for increasing wear and fatigue resistance of steel parts. Either of the two conventional nitriding processes, namely gas nitriding and salt-bath nitriding, can be performed without difficulty on parts made of alloy steels. However, the nitriding of stainless steel (austenitic, martensitic and precipitation hardening) presents difficulties because of the presence of a passive oxide film on the surface of the stainless steel part which inhibits nitriding. Special procedures have therefore been developed for nitriding stainless steel parts, including one known as "Malcomizing" in which chemical pills are added to the retort during the nitriding process, the decomposition of the pills causing depassivation of the protective oxide film, and another known as "Ionitriding," in which the nitriding takes place in the plasma of a current-intensive glow discharge. Such procedures, however, involve the use of expensive ingredients and/or expensive equipment.

SUMMARY OF THE INVENTION

An object of the present invention is to provide a new method of surface hardening stainless steel parts having advantages in the above respects.

4–30% of a cyanide, and 10–30% of a cyanate, for a time period of a few minutes to two hours, at a temperature of 540–600° C.; and (b) then subjecting the stainless steel part to a nitriding process.

Preferably, the cyanide is sodium cyanide, and the cyanate is sodium cyanate.

In the preferred embodiments of the invention described below, the sulphur content of the salt bath in step (a) is 0.1–0.3%; the sodium cyanide content is 5–25%; and the sodium cyanate content is 12–25%.

It has been found that the above process inhibits the formation of the oxide film while the nitriding is being carried out. The product is preferably cleaned by means of a vapour blast and subsequently its surface is subjected to the above-described thermo-chemical treatment before being placed in the nitriding furnace.

The process may be used with either of the conventional nitriding procedures, i.e., gas nitriding or salt bath nitriding.

Experiments performed in dissociated ammonia on samples representative of austenitic (AISI types 303 and 321), martensitic (AISI types 410 and 416), and precipitation hardening (17-4 PH and PH 15-5) stainless steel produced a nitrided case which was continuous and uniform and which possessed the required hardness (greater than 92 R 15N). The case depth was more than 0.15 mm, with a white layer thinner than 12 microns and of a uniform microstructure.

SPECIFIC EXAMPLES OF THE INVENTION

Several specific examples illustrating this new nitriding method are given in Table 1.

Table 1

| | The thermochemical pre-treatment | | | Test results | | | | |
|---|---|---|---|---|---|---|---|---|
| | | | | Hardness | | | Case depth | White layer |
| Material | Composition | Temp. & time | The nitriding gas cycle | R 15N | R 30N | R 45N | (mm) | (μ) |
| 17-4PH (H 1075) | S-0.3% NaCN-12% NaCNO-25% | 570° C. 1 hr | 540° C.; 38 hr; Dissoc. ammonia to 25–35% | 92.5 | 73.5 | 55.5 | 0.14 | — |
| 17-4PH (H 1050) | S-0.14% NaCN-6.7% NaCNO-15% | 540° C. 1 hr | 540° C.; 40 hr; Dissoc. ammonia to 25–35% | 92.5 | — | — | 0.15 | — |
| 17-4PH (h 1050) | S-0.18% NaCN-23.1% NaCNO-12.8% | 540° C. 1 hr | 540° C.; 40 hr; Dissoc. ammonia to 25–35% | 92.0 | — | — | 0.16 | — |
| AISI type 410(Hardened & tempered at 580° C.) | S-0.3% NaCN-12% NaCNO-25% | 570° C. 1 hr | 540° C.; 38 hr; Dissoc. ammonia to 25–35% | 94.5 | 83.5 | 65 | 0.25 | 12 |
| AISI type 410(Hardened & tempered at 580° C.) | S-0.14% NaCN-6.7% NaCNO-15% | 540° C. 1 hr | 540° C.; 40 hr; Dissoc. ammonia to 25–35% | 93.0 | — | — | 0.24 | 7 |
| AISI 410 (Hardened & tempered at 580° C.) | S-0.18% NaCN-23.1% NaCNO-12.8% | 540° C. 1 hr | 540° C.; 40 hr; Dissoc. ammonia to 25–35% | 93.0 | — | — | 0.24 | 5 |
| AISI 321 (ANN) | S-0.3% NaCN-12% NaCNO-25% | 570° C. 1 hr | 540° C.; 38 hr; Dissoc. ammonia to 25–35% | 94.0 | 73.0 | 51.5 | 0.16 | — |
| AISI 321 (ANN) | S-0.14% NaCN-6.7% NaCNO-15% | 540° C. 1 hr | 540° C.; 40 hr; Dissoc. ammonia to 25–35% | 92.0 | — | — | 0.17 | — |
| AISI 321 (ANN) | S-0.18% NaCN-23.1% NaCNO-12.8% | 540° C. 1 hr | 540° C.; 40 hr Dissoc. ammonia to 25–35% | 92.0 | — | — | 0.14 | — |

According to a broad aspect of the present invention, there is provided a method of surface hardening stainless steel parts for increasing their wear and fatigue resistance, comprising: (a) subjecting the surface of the stainless steel part to a pre-treatment in a salt bath containing, by weight, from 0.1% up to 0.5% sulphur, In the pre-treatment baths of Table 1, the balance or remaining ingredients are mainly carrier agents, such as sodium carbonate and sodium chloride, and are not active in the treatment itself. For illustration purposes, the original bath composition in the first-listed example included, in addition to the ingredients listed, 25% sodium carbonate and 42.7% sodium chloride, although of course the composition changes during use.

The white layer mentioned as the last item in Table 1 is a thin compound layer which consists of $Fe_{2-4}N$ and appears on the surface of the part during the nitriding cycle. This layer is very brittle. It becomes spalled after a short time in service and causes scuffing and seizure of contact parts. It must be as thin as possible after the completion of the nitriding process.

Preferably, the stainless steel part is subjected to a vapour blast treatment (tap water aerated under a pressure of 60–90 psi) before both the salt bath treatment and the nitriding treatment.

It is believed that the mechanism of action of the present invention is a surface depassivation based on the enrichment of the surface layer by nitrogen and dilution of chrome from the solid solution matrix.

With this method, it is possible to nitride all types of stainless steel parts with conventional equipment commonly used for the nitriding of alloy steels.

While the invention has been described with respect to a number of preferred examples, it will be appreciated that many variations, modifications and other applications of the invention may be made.

What is claimed is:

1. A method of surface hardening stainless steel parts for increasing their wear and fatigue resistance, comprising:

(a) subjecting the surface of the stainless steel part to a pre-treatment in a salt bath containing, by weight, 0.1–0.5% sulphur, 4–30% of a cyanide, and 10–30% of a cyanate, the balance being mainly non-active carrier agents, for a time period of a few minutes to two hours, at a temperature of 540–600° C.; and (b) then subjecting the stainless steel part to a nitriding process; said pre-treatment of step (a) inhibiting the formation of an oxide film while the nitriding process of step (b) is carried out.

2. The method according to claim 1, wherein the sulphur contents of the salt bath is 0.1–0.3%.

3. The method according to claim 2, wherein the cyanide is sodium cyanide, and the cyanate is sodium cyanate.

4. The method according to claim 2, wherein the sodium cyanide is present from 5–25%.

5. The method according to claim 2, wherein the sodium cyanate is present from 12–25%.

6. The method according to claim 1, wherein said time period in step (a) is about one hour.

7. The method according to claim 1, wherein said step (b) is an ammonia gas nitriding process.

8. The method according to claim 1, wherein before step (a), the stainless part is first cleaned by means of a vapour blast.

9. The method according to claim 1, wherein the stainless steel part is cleaned by means of a vapour blast before step (b).

* * * * *